FIP7912 OR 4,136,738

United States Patent [19]

Haynes, Jr. et al.

[11] 4,136,738

[45] Jan. 30, 1979

[54] ENHANCED RECOVERY OF OIL FROM A DIPPING SUBTERRANEAN OIL-BEARING RESERVOIR USING LIGHT HYDROCARBON AND CARBON DIOXIDE

[75] Inventors: Stewart Haynes, Jr., Houston; Frank H. Lim, Katy; Robert B. Alston, Missouri City, all of Tex.

[73] Assignee: Texaco, Inc., New York, N.Y.

[21] Appl. No.: 827,413

[22] Filed: Aug. 24, 1977

[51] Int. Cl.[2] ..... E21B 43/22

[52] U.S. Cl. ..... 166/273

[58] Field of Search ..... 166/273, 274, 305 R

[56] References Cited

U.S. PATENT DOCUMENTS

| | | | |
|---|---|---|---|
| 2,822,872 | 2/1958 | Rzasa | 166/273 |
| 3,003,554 | 10/1961 | Craig, Jr. et al. | 166/274 |
| 3,126,951 | 3/1964 | Santourian | 166/274 X |
| 3,157,230 | 11/1964 | Connally, Jr. et al. | 166/274 |
| 3,207,217 | 9/1965 | Woertz | 166/273 |
| 3,346,046 | 10/1967 | Boston | 166/273 |
| 3,616,854 | 11/1971 | Braden, Jr. | 166/274 |
| 3,811,501 | 5/1974 | Burnett et al. | 166/273 X |
| 3,811,502 | 5/1974 | Burnett | 166/273 X |
| 3,811,503 | 5/1974 | Burnett et al. | 166/273 X |
| 3,854,532 | 12/1974 | Braden, Jr. | 166/273 X |

*Primary Examiner*—Stephen J. Novosad
*Assistant Examiner*—George A. Suchfield
*Attorney, Agent, or Firm*—Thomas H. Whaley; Carl G. Ries; Charles L. Bauer

[57] ABSTRACT

Recovery of oil from a dipping subterranean oil-bearing reservoir is effected by the injection of a first slug of a light hydrocarbon at a high rate to insure mixing with the reservoir oil adjacent the injection well followed by the injection of a second slug of carbon dioxide at a low rate to form a conditionally miscible transition zone with the altered reservoir oil and thereafter by the injection of a drive agent.

15 Claims, No Drawings

ENHANCED RECOVERY OF OIL FROM A DIPPING SUBTERRANEAN OIL-BEARING RESERVOIR USING LIGHT HYDROCARBON AND CARBON DIOXIDE

FIELD OF THE INVENTION

This invention relates to the recovery of oil from a dipping subterranean oil-bearing reservoir by the injection thereinto of a first slug of a light hydrocarbon at a rate to insure its mixing with the reservoir oil, thereby altering the composition of the reservoir oil adjacent the injection well, followed by the injection of a second slug of carbon dioxide that is conditionally miscible with the altered reservoir oil in the vicinity of the injection well and thereafter by the injection of a drive agent to displace the injected fluids and the reservoir oil through the reservoir to a production well from which they are produced.

DESCRIPTION OF THE PRIOR ART

In the recovery of oil from subterranean oil-bearing reservoirs normally primary recovery methods are initially employed that utilize the reservoir energy present in the reservoir in the form of water under pressure or gas either in solution or under pressure. After the primary energy of the reservoir has been expended, additional oil may be recovered by employing secondary methods in which energy is supplied to the reservoir from an external source, such as the injection of water as in a waterflood.

Additional recovery may be realized by employing other recovery methods after a reservoir has been waterflooded to an uneconomic level. These subsequent recovery procedures have been termed "enhanced recovery" or "tertiary recovery" in the art.

One of these newer methods for enhanced recovery that has been practiced is termed "miscible flooding", wherein a fluid is injected into the reservoir that is miscible with the reservoir oil at reservoir conditions of temperature and pressure. The term "miscible" as used herein means that the injected fluid is soluble in all proportions with the reservoir oil at reservoir conditions of temperature and pressure.

Miscible flooding is effective in stripping and displacing the reservoir oil from the reservoir matrix through which the miscible fluid flows. When miscibility exists between the injected fluid and the reservoir oil at the conditions of temperature and pressure of the reservoir, a single phase fluid is present, and the retentive forces of capillarity and interfacial tension are eliminated. These forces are significant factors in reducing the recovery efficiency of oil in conventional flooding operations, such as waterflooding, where the displacing agent and the reservoir oil exist as two phases.

Miscible flooding is normally accomplished by displacement techniques whereby a solvent fluid that is miscible with the reservoir oil at reservoir conditions is injected into the reservoir which fluid frees the oil from the reservoir matrix and displaces it through the reservoir toward a production well from which the oil is produced. Normally, the fluids used are light hydrocarbons in the range of $C_2$ to $C_6$. In particular, liquid petroleum gas (LPG) has been extensively employed.

Because of the expense and limited availability of the light hydrocarbons, advances in the art have included the use of a slug of the solvent fluid, thereby minimizing the amount of solvent required. By the slug method, a fraction of a pore volume of solvent fluid is injected, which is then followed by a cheaper and/or more available drive agent. One such material employed as a drive agent is natural gas. In the slug type miscible flood the solvent fluid is miscible with the oil at the leading edge of the slug and may or may not be miscible with the drive agent at the trailing edge of the slug. In U.S. Pat. No. 3,354,953, for example, a miscible slug process is taught in which a slug of liquid miscible with the oil is injected in amounts sufficient to form a band of substantially pure miscible liquid that is also miscible with the drive agent that is subsequently injected.

Prior art has also recognized that miscibility may be either "first contact" miscibility or "conditional" miscibility. Conditional miscibility is distinguished from first contact miscibility by the fact that miscibility is achieved in the conditional miscibility situation by a series of multiphase contacts between the injected fluid and the reservoir oil. As to the type of miscibility obtained, this is determined by reservoir conditions and compositions of fluids. Methods for achieving one or the other type are described in the art. Conditional miscibility may also be divided into a vaporizing gas type in which intermediate components of the oil are vaporized into the injected fluid until miscibility is attained, or enriched gas type wherein the intermediates of the injected fluid are absorbed by the oil until miscibility is obtained.

It has also been long known that carbon dioxide may be utilized as a recovery agent because of its ability to dissolve in the oil, thereby causing swelling of the oil and a reduction in viscosity, both of which aid in increasing oil recovery. In one teaching employing carbon dioxide in U.S. Pat. No. 3,262,498, carbon dioxide preferably is injected in the liquid state into a reservoir where it goes into solution in the oil to give the beneficial effects of swelling and viscosity reduction, and thereafter a liquefied hydrocarbon is injected to that a transition zone is formed to obtain an improved sweep efficiency. Subsequent to the injection of the liquefied hydrocarbon, a drive fluid or agent is injected to displace the reservoir fluids to a production well, from which they are produced. In other developments, carbon dioxide has been suggested as a recovery agent under conditions of miscibility with the oil, wherein a slug of carbon dioxide is injected at high pressure or at conditions of miscibility, which slug is thereafter driven by an inert gas or water.

More recently the use of carbon dioxide has been disclosed wherein the carbon dioxide is employed at conditions of conditional miscibility with the reservoir oil. For example, in U.S. Pat. No. 3,811,502 a zone of conditional miscibility between the carbon dioxide and the oil is established, after which a drive agent is injected as the displacing force. In another development as taught in U.S. Pat. No. 3,811,503 a slug of a mixture of a light hydrocarbon and carbon dioxide is injected that is conditionally miscible with the reservoir oil, which slug is followed by a drive agent. The amount of light hydrocarbon and carbon dioxide present in the slug are in a critical ratio which ratio assures that conditional miscibility will exist between the slug and the reservoir oil.

The instant invention discloses an advance in the use of carbon dioxide in a miscible flood whereby, prior to the injection of the carbon dioxide, the reservoir oil in the vicinity of the injection well is altered by the injection of a light hydrocarbon at a rate to insure mixing with the reservoir oil so that the altered fluid is conditionally miscible with the later-injected carbon dioxide. By the method of invention not only are the higher pressures required for utilizing carbon dioxide alone as the miscible fluid not necessary, but also smaller amounts of the light hydrocarbon are effective. In addition, by means of the instant invention it is not required that a band of substantially pure solvent be established and maintained as the flood proceeds. Nor is it required that leading edge miscibility be established between the reservoir oil and the injected hydrocarbon fluid.

It is thus an object of the instant invention to extend the effectiveness of the use of carbon dioxide for in-situ oil recovery to reservoirs not previously amenable to miscible flood operations employing carbon dioxide because of formation pressure limitations.

SUMMARY OF THE INVENTION

This invention relates to the recovery of oil from a dipping subterranean oil-bearing reservoir wherein a slug of a light hydrocarbon is rapidly injected into the reservoir to alter the composition of the reservoir oil in the vicinity of the well bore and thereafter a slug of carbon dioxide is injected at a slow rate whereby a conditionally miscible transition zone is formed with the altered reservoir fluid. Thereafter, a drive agent is injected to displace the injected fluids and reservoir oil through the reservoir toward a production well from which they are produced.

DESCRIPTION OF THE INVENTION

This invention relates to the recovery of oil from a dipping subterranean oil-bearing reservoir at reservoir conditions of temperature and pressure at which carbon dioxide is soluble in, but not miscible with, the reservoir oil.

In its broadest aspect the invention comprises introducing into a dipping subterranean oil-bearing reservoir a slug of a light hydrocarbon at an injection rate high enough in amounts sufficient to form a mixture of the reservoir oil and the light hydrocarbons in the vicinity of the injection well. Thereafter, a slug of carbon dioxide is injected at a low rate to form a transition zone of conditional miscibility with the altered fluid around the injection well. After sufficient carbon dioxide has been injected, a drive agent is injected to displace the injected fluids and the reservoir oil through the reservoir toward a production well from which they are produced.

The instant invention employs a first slug of hydrocarbon to condition the reservoir in the vicinity of the injection well prior to the injection of carbon dioxide. The injected slug of hydrocarbon is injected at rates high enough to cause mixing of the light hydrocarbon and the reservoir oil in the vicinity of the injection well to provide an altered resevoir fluid that at reservoir conditions of temperature and pressure is conditionally miscible with the later-to-be injected carbon dioxide. There is no necessity that the injected first slug be capable of miscibility with the reservoir oil. The amount of slug injected can be determined by calculation utilizing reservoir mechanics, and the composition necessary to assure that the altered reservoir fluid have miscibility with the carbon dioxide can be determined by laboratory tests.

The invention resides in the dipping fact that the reservoir is flooded at reservoir conditions by altering the composition of the fluid aroung the injection well bore so that a conditional miscible carbon dioxide flood can then be conducted. The method is applicable to, but not restricted to, reservoirs which are too low in pressure to allow for carbon dioxide alone to have conditional miscibility with the reservoir oil. Conditional miscibility within the meaning of this invention has been defined heretofore and is to be distinguished from first contact or instant miscibility. The conditional miscibility is achieved by a series of transition multiphase contacts wherein the light hydrocarbons in the altered oil zone around the injection well are absorbed into the carbon dioxide thereby creating in-situ a miscible transition zone between the altered fluid and the carbon dioxide slug.

In demonstrating the invention a series of slim tube tests was conducted using a 40 foot long stainless steel tube (0.25" diameter). The tube was packed with Ottawa 40–60 mesh sand. Suitable temperature and pressure controls and production measuring devices were employed.

In operation the sand pack was saturated with the oil of interest to give an initial oil saturation ($S_{oi}$) of 1.00; thereafter, the sand-packed tube was initially waterflooded to irreducible oil saturation ($S_{or\text{-}1}$). The displacing fluid (or fluids) of interest was then injected in a predetermined amount and at a given rate and the oil displacement was monitored by means of observing the effluent from the tube. Thereafter, a drive fluid was injected. Observation of the first appearance of a second phase was noted in a high-pressure sight glass. Recovery, measured as residual oil saturation ($S_{or\text{-}2}$), was determined at the time there was no further recovery of oil.

A series of tests using a given reservoir oil, having an API of 32°, was conducted at a pressure of 2730 psia and a temperature of 160° F. Calculation of the size of the slug was based on the minimum miscibility pressure correlation for carbon dioxide and oil and assuming that the first 4 to 5 feet of the tube was needed to establish conditional miscibility.

The procedure and results from the test are given in the accompanying table.

The results demonstrate that improved recovery can be obtained by the use of a conditioning slug of a light hydrocarbon prior to the undertaking of a conditionally miscible carbon dioxide flood. Furthermore, the results show that high recovery can be obtained even when the size of the conditioning slug is of the order of 1.5% PV (Pore Volume), which is significantly smaller than slug sizes used in conventional miscible slug floods, that are generally of the order of 3 to 10% PV.

For example Run 5 in which a conditioning slug of butane was used (1.5% PV) the recovery efficiency ($E_r$) for the tertiary or enhanced portion of the run was 95.0%. A larger conditioning slug of 3% PV in Run 2 gave a recovery efficiency ($E_r$) of 96.9%. These results contrast favorably with the recovery efficiency obtained for either a carbon dioxide enhanced recovery flood (Run 1) or the use of a mixture of butane and carbon dioxide (Run 4) in which the amount of $C_4$ was 3.2% PV which recovery efficiencies ($E_r$) were 56.4% and 79.9% respectively.

| Run No. | Steps In Procedure | $S_{or\text{-}1}$ | $S_{or\text{-}2}$ | RECOVERY EFFICIENCY $E_r$ | $E_r$ | $E_r$ Total |
|---|---|---|---|---|---|---|
| | 1. Waterflood | 0.304 | | 69.6 | | |

-continued

| Run No. | Steps In Procedure | $S_{or-1}$ | $S_{or-2}$ | RECOVERY EFFICIENCY $E_r$ | $E_{r'}$ | $E_r$ Total |
|---|---|---|---|---|---|---|
| (1) | 2. Inject $CO_2$ (30%PV) | | | | | |
| | 3. Waterflood | | 0.133 | | 56.4 | 86.7 |
| | 1. Waterflood | 0.291 | | 70.9 | | |
| (2) | 2. Inject $C_4$ (3%PV) | | | | | |
| | 3. Inject $CO_2$ (30%PV) | | | | | |
| | 4. Waterflood | | 0.009 | | 96.9 | 99.1 |
| | 1. Waterflood | 0.266 | | 73.4 | | |
| (3) | 2. Inject mixture of (6.4%-$C_4$) (33%PV) (93.6%-$CO_2$) | | | | | |
| | 3. Displace with $N_2$ | | 0.013 | | 95.3 | 98.8 |
| | 1. Waterflood | 0.279 | | 72.1 | | |
| (4) | 2. Inject mixture of (3.2%-$C_4$) (33% PV) (96.8%-$CO_2$) | | | | | |
| | 3. Displace with $N_2$ | | 0.056 | | 79.9 | 94.4 |
| | 1. Waterflood | 0.325 | | 67.5 | | |
| (5) | 2. Inject $C_4$ (1.5%PV) | | | | | |
| | 3. Inject $CO_2$ (30%PV) | | | | | |
| | 4. Waterflood | | 0.016 | | 95.0 | 98.4 |

$$E_r = \frac{\text{Volume of oil recovered during initial waterflood}}{\text{Volume of oil originally in place}}$$

$$E_{r'} = \frac{\text{Volume of oil recovered during tertiary phase}}{\text{Volume of oil in place at start of tertiary phase}}$$

$$E_{r\,Total} = \frac{\text{Total volume of oil recovered}}{\text{Volume of oil originally in place}}$$

The following field example further demonstrates the invention as applied to an oil-bearing reservoir at a depth of 9100 ft, with a dip of 27° and containing a 37° API oil. The reservoir was at a pressure of 3788 psia and a temperature of 216° F. At reservoir conditions the conditional contact miscibility pressure is 4166 psia for $CO_2$ and the in-place oil. An injection well and a production well were located about 575 feet apart. The reservoir had previously undergone waterflooding. In the test about 20,000 gallons or 0.04% PV of a butane/propane mixture was injected at a rate fast enough to insure mixing of the hydrocarbon material with the reservoir oil in the vicinity of the injection well bore. The injection rate employed was greater than the critical velocity at the solvent-oil interface which for the particular example, was greater than 5 ft/day.

Calculations indicated that about 156,000 gallons of the reservoir oil has been altered by the mixing thereinto of the butane/propane hydrocarbon slug. The altered composition was such that the pressure for conditional miscibility was about 3600 psia, as determined by the slim tube tests. After the hydrocarbon slug had been injected, a slug of carbon dioxide was injected at rates adjusted to balance the production volume. About 20% PV of carbon dioxide was injected. The injection rate of $CO_2$ was kept below the critical velocity for $CO_2$ and the reservoir oil which was about 2 ft/day. Thereafter, a drive fluid of nitrogen was injected to displace the reservoir fluids toward the production well from which they were produced. Recovery was about 80% of the estimated oil in the swept volume.

In the practice of the invention a first slug of a light hydrocarbon is injected into the reservoir via the injection well to condition the reservoir adjacent the injection well by altering the composition of the reservoir oil or fluid. The hydrocarbon is injected at a rate high enough to insure its mixing with the reservoir oil. The rate should be greater than the critical velocity at the solvent-oil interface which generally is in the range of 0.5 ft/day to 15 ft/day. Critical velocity is defined as the velocity at which the velocity forces become greater than the gravitational forces. At that point viscous fingering of the displacing fluid begins and thereafter continues to grow. Critical velocity can be determined from methods well-known in the art. For example, the critical velocity ($v_c$) can be calculated by the theoretical equation:

$$v_c = \frac{k\,\Delta\rho}{\phi\,\Delta\mu}\sin\alpha$$

where $k$ = permeability $\Delta p$ = density difference between displaced and displacing fluids $\Delta\mu$ = viscosity difference between displaced and displacing fluids $\alpha$ = angle of dip of reservoir $\phi$ = fractional porosity of the porous media The amount of light hydrocarbon required can be calculated using a correlation of minimum miscibility pressure as a function of oil composition and other parameters, and a minimum length of 4–5 feet to establish miscibility. This distance applies to stable flow conditions in dipping reservoirs where viscous fingering is absent. Generally the amount of light hydrocarbon required is in the range of from about 0.02% to about 5.0% pore volume.

As an example, a given reservoir containing a 32° API oil, with an oil saturation of 25% and a pressure of 2700 psia and a temperature of 160° F. has the following composition:

$C_1 + N_2$; 41.27%

$C_2$-$C_4$; 6.99%

$C_5$+; 51.74%

Using the minimum miscibility correlation, a minimum pressure of 3400 psia is required to attain conditional miscibility between the reservoir oil and carbon dioxide. Again using the correlation, the minimum conditional miscibility pressure could be reduced to the existing reservoir pressure of 2700 psia. Since only 5 feet of reservoir length is needed to establish conditional miscibility, only the immediate area adjacent the injection well bore need be treated. If the distance between the injection and production well is 300 feet, the fraction of the reservoir pore volume (PV) adjacent the injection well that must be treated would be:

$$PV = \frac{5}{300} = 0.017 \text{ or } 1.7\%$$

The light hydrocarbon solvent employed may be any light hydrocarbon having from 2 to 6 carbon atoms in the molecule. Examples are ethane, propane, LPG, butane, pentane and hexane. The solvent can also be a mixture of light hydrocarbons and may contain methane, the mixture being selected such that after having been mixed with the reservoir oil, the altered composition is capable of forming a conditional miscible zone with carbon dioxide. Such compositions for the hydrocarbon slug can be determined by means of slim tube tests such as described in U.S. Pat. No. 3,811,502.

After having established a zone of altered fluid around the injection well, a slug of carbon dioxide is injected at a sufficiently low rate and in amounts such that a transition zone having conditional miscibility is formed with the altered fluid and stable flow is maintained. In the injection of the carbon dioxide the rate of injection should be less than the critical velocity at the carbon dioxide-altered fluid interface, usually in the range of about 0.03 ft/day to about 10 ft/day. The amount of carbon dioxide injected may be in the range of 10% to 30% pore volume. The carbon dioxide slug may comprise carbon dioxide or it may contain inert gas such as is taught in U.S. Pat. No. 3,811,501 or light hydrocarbons such as is taught in U.S. Pat. No. 3,811,503. The ratio of the inert gas or light hydrocarbon to the carbon dioxide at which conditional miscibility may be attained has a critical ratio, which ratio can be determined by means in the lagoratory for exmple a slim tube test.

By an inert gas is meant a bas with a solubility in the hydrocarbon fluid with which it will be in contact of less than that of carbon dioxide. Examples of inert gases are methane, natural gas, separator gas, flue gas, nitrogen, and air and mixtures thereof. Examples of the light hydrocarbon include ethane, propane, LPG, butane and mixtures thereof.

A drive agent is then injected to drive injected fluids and the reservoir oil through the reservoir, towards the production well from which they are produced. The drive agent may be any relatively inexpensive fluid, including gas such as nitrogen, air, combustion or flue gas, separator gas, natural gas or mixtures thereof. The drive agent may also be water, brine and/or thickeners and contain additives such as a surfactant to improve displacement efficiency and improve the oil recovery.

The drive agent is injected in amounts sufficient to displace the reservoir oil or fluids through the reservoir and is injected at a rate not to exceed the critical value determined for the carbon dioxide-altered oil interface so that the preferred rate of movement through the reservoir is from about 0.03 ft/day to about 10 ft/day. It is within the scope of the invention to apply the method to dipping reservoirs by the injection of the carbon dioxide slug either into an up-dip injection well or into a down-dip injection well. The method of selection in the application to dipping reservoirs is determined by reservoir conditions and the characteristics of the reservoir fluids, as for example the density of the crude oil at reservoir temperature and pressure. The method may also be applied as a vertical displacement wherein the slugs are injected at the top of the oil-bearing reservoir and a blanket or layer of the carbon dioxide slug is established prior to the injection of the drive agent, which agent which agent displaces the said blanket and reservoir oil downwardly through the reservoir, toward suitably placed production wells, from which the fluids are produced.

In summary, in accordance with the practice of this invention, recovery of oil from a dipping reservoir is accomplished by a conditional miscible carbon dioxide flood where prior to the injection of the carbon dioxide a conditioning slug of a light hydrocarbon is injected into the reservoir at rates to cause its mixing with the reservoir oil in the vicinity of the injection well so as to form a reservoir fluid of altered composition, that is conditionally miscible with carbon dioxide. After a sufficient amount of the light hydrocarbon is introduced, a slug comprising carbon dioxide is introduced at a rate less than the critical velocity and in sufficient amounts to establish and maintain a zone conditional miscibility with the altered fluid. Thereafter there is introduced a drive agent such as gas or water. The injection of the drive agent is continued so as to displace the injected fluids and the reservoir oil through the reservoir toward a production well from which they are produced.

We claim:

1. A method for the recovery of oil from a dipping subterranean oil-bearing reservoir traversed by at least one injection well and one production well said oil being immiscible with carbon dioxide at the reservoir conditions of temperature and pressure, comprising the steps of:

(a) injecting via said injection well a first slug of light hydrocarbon at a rate exceeding the critical velocity and in amounts sufficient to form a mixture of altered fluid of reservoir oil and light hydrocarbon adjacent said injection well, said mixture being conditionally miscible with carbon dioxide at the reservoir conditions of temperature and pressure, (b) injecting via said injection well a second slug comprising carbon dioxide at a rate less than the critical velocity and in amounts sufficient to form a transition zone of conditional miscibility between said mixture and said carbon dioxide slug, (c) injecting via said injection well a drive agent to displace said altered fluid and second slug and reservoir oil through said reservoir toward said production well, (d) producing said reservoir oil via said production well.

2. The method of claim 1 wherein said light hydrocarbon is selected from the group of light hydrocarbons having from 2 to 6 carbon atoms per molecule, and mixtures thereof.

3. The method of claim 2 wherein said light hydrocarbon is ethane, propane, LPG, butane, pentane, hexane and mixtures thereof.

4. The method of claim 1 wherein said light hydrocarbon is injected at a rate in the range of about 0.5 ft/day to about 15 ft/day.

5. The method of claim 1 wherein said first slug is injected in amounts of from about 0.02% to about 5% pore volume.

6. The method of claim 1 wherein said second slug comprises carbon dioxide and contains inert gas, wherein the ratio of inert gas to carbon dioxide is the ratio at which said slug is conditionally miscible with said mixture of altered reservoir fluid.

7. The method of claim 6 wherein said inert gas is selected from the group consisting of methane, natural gas, separator gas, flue gas, air, nitrogen and mixtures thereof.

8. The method of claim 7 wherein said second slug comprises carbon dioxide and contains light hydrocarbon, wherein the ratio of light hydrocarbon to carbon dioxide is the ratio at which said slug is conditionally miscible with said mixture of altered reservoir fluid.

9. The method of claim 8 wherein said light hydrocarbon is selected from the group consisting of ethane, propane, LPG, butane and mixtures thereof.

10. The method of claim 1 wherein said second slug is injected in amounts of from about 10% to about 30% pore volume.

11. The method of claim 1 wherein said second slug is injected at a rate in the range of about 0.03 ft/day to about 10 ft/day.

12. The method of claim 1 wherein said drive agent is selected from the group consisting of air, nitrogen, combustion gas, separator gas, natural gas, methane, and mixtures thereof.

13. The method of claim 1 wherein said drive agent is water, said water being fresh water, brine, reservoir water, thickened water and mixtures thereof.

14. The method of claim 13 wherein said water contains surfactants, thickeners, and mixtures thereof.

15. The method of claim 1 wherein said injection is at the top of said reservoir, said displacement is in a substantially vertical direction downward and said production is from the bottom.

* * * * *